US011605342B2

(12) United States Patent
Lee et al.

(10) Patent No.: US 11,605,342 B2
(45) Date of Patent: Mar. 14, 2023

(54) SELF-EMISSION DISPLAY DEVICE AND SELF-EMISSION DISPLAY PANEL

(71) Applicant: LG Display Co., Ltd., Seoul (KR)

(72) Inventors: SeungHyuck Lee, Seoul (KR); Hyojung Park, Incheon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/464,554

(22) Filed: Sep. 1, 2021

(65) Prior Publication Data

US 2022/0076625 A1 Mar. 10, 2022

(30) Foreign Application Priority Data

Sep. 8, 2020 (KR) ..... 10-2020-0114903

(51) Int. Cl.
*G09G 3/3233* (2016.01)
*G09G 3/32* (2016.01)

(52) U.S. Cl.
CPC ..... *G09G 3/3233* (2013.01); *G09G 3/32* (2013.01); *G09G 2300/0413* (2013.01); *G09G 2300/0842* (2013.01); *G09G 2320/029* (2013.01); *G09G 2320/0233* (2013.01); *G09G 2320/045* (2013.01); *G09G 2330/08* (2013.01)

(58) Field of Classification Search
CPC ... G09G 3/32–3291; G09G 2300/0413; G09G 2300/0421–043; G09G 2300/0439; G09G 2300/0842; G09G 2310/02; G09G 2310/0202; G09G 2310/0243; G09G 2310/0248; G09G 2310/0251; G09G 2310/0294; G09G 2310/06; G09G 2310/08; G09G 2320/02; G09G 2320/0233; G09G 2320/0242; G09G 2320/029; G09G 2320/043; G09G 2320/045; G09G 2320/0693; G09G 2330/08–12
See application file for complete search history.

(56) References Cited

U.S. PATENT DOCUMENTS

2005/0052350 A1* 3/2005 Mizukoshi ..... G09G 3/3233 345/55
2005/0088103 A1* 4/2005 Kageyama ..... G09G 3/325 315/169.3
2006/0145969 A1* 7/2006 Fish ..... G09G 3/3233 345/77

(Continued)

FOREIGN PATENT DOCUMENTS

KR 2020071603 A * 6/2020 ..... G09G 3/32

OTHER PUBLICATIONS

English translation of KR-2020071603-A (Year: 2020).*

*Primary Examiner* — Nathan Danielsen
(74) *Attorney, Agent, or Firm* — Fenwick & West LLP

(57) ABSTRACT

Embodiments of the disclosure relate to a self-emission display device and a self-emission display panel and include a fake subpixel disposed in a non-display area of the self-emission display panel and including a reference transistor controlled by a control signal and connected between a first voltage node and a detection node and a bias transistor controlled by a bias voltage and connected between a second voltage node and the detection node. Thus, it is possible to restore the initial characteristic value of the driving transistor in the subpixel disposed in the display area by driving the fake subpixel.

20 Claims, 12 Drawing Sheets

(56) References Cited

U.S. PATENT DOCUMENTS

| | | | | |
|---|---|---|---|---|
| 2014/0292827 | A1* | 10/2014 | Kang | G02F 1/136259 345/76 |
| 2017/0061866 | A1* | 3/2017 | In | G09G 3/3233 |
| 2018/0053462 | A1* | 2/2018 | Bae | G09G 3/2074 |

* cited by examiner

SELF-EMISSION DISPLAY DEVICE AND SELF-EMISSION DISPLAY PANEL

CROSS-REFERENCE TO RELATED APPLICATION

This application claims priority from Republic of Korea Patent Application No. 10-2020-0114903, filed on Sep. 8, 2020, which is hereby incorporated by reference in its entirety.

BACKGROUND

Field

Embodiments of the disclosure relate to a self-emission display device and a self-emission display panel.

Description of Related Art

Among displays currently developed, self-emission displays include light emitting elements in the subpixels on the display panel. Each subpixel includes a self-emission light emitting element and a transistor for driving the light emitting element.

Circuit elements, such as driving transistors and light emitting elements, disposed on self-emission display panel have their own intrinsic characteristic values. For example, driving transistors have a threshold voltage and mobility, and light emitting elements have a threshold voltage, as their intrinsic characteristic values.

The circuit elements in each subpixel may degrade over driving time so that their intrinsic characteristic values may vary. The driving time may differ per subpixel. Thus, a deviation in characteristic value may occur between the circuit elements of subpixels, causing a luminance deviation between subpixels. The luminance deviation may deteriorate the luminance uniformity of the self-emission display panel, with the result of poor image quality.

Various techniques have been developed to sense and compensate for luminance deviations between subpixels. However, conventional compensation techniques may not correctly compensate for luminance deviations between subpixels due to failure to precisely figure out variations in the characteristic values of the circuit elements in the subpixels.

SUMMARY

According to the above-described embodiments of the disclosure, there may be provided a self-emission display device and self-emission display panel that may precisely grasp variations in the characteristic values of the circuit elements in the subpixels after shipped and correctly compensate for luminance deviations between the subpixels by sensing and storing, in memory, the initial characteristic values of circuit elements in the subpixels disposed in the self-emission display panel before the self-emission display panel is shipped.

According to the embodiments of the disclosure, there may be provided a self-emission display device and self-emission display panel that may restore the initial characteristic values of circuit elements in the subpixels disposed on the self-emission display panel when the initial characteristic values of the circuit elements in the subpixels are lost or damaged, and may thus continuously perform precise compensation processing.

According to the embodiments of the disclosure, there may be provided a self-emission display device and self-emission display panel that includes an initial characteristic value restoration circuit capable of restoring the initial characteristic values of circuit elements in the subpixels disposed on the self-emission display panel when the initial characteristic values of the circuit elements are lost from the memory or damaged.

According to an embodiment, there may be provided a self-emission display device comprises a self-emission display panel including a display area and a non-display area around the display area, the self-emission display panel including a plurality of subpixels disposed in the display area and a plurality of data lines and a plurality of gate lines connected with the plurality of subpixels, each of the plurality of subpixels including a light emitting element and a driving transistor, a data driving circuit driving the plurality of data lines, a gate driving circuit driving the plurality of gate lines, a fake subpixel disposed in the non-display area of the self-emission display panel and including a reference transistor and a bias transistor, the reference transistor controlled by a control signal and connected between a first voltage node and a detection node, and the bias transistor controlled by a bias voltage and connected between a second voltage node and the detection node, a detection unit connected with the fake subpixel, detecting a voltage of the detection node in the fake subpixel, and outputting a detection value, and a control module controlling driving of the fake subpixel based on the detection value.

The fake subpixel disposed in the non-display area may be a non-self-emission subpixel.

A variation in a characteristic value of the reference transistor included in the fake subpixel disposed in the non-display area may be smaller than a variation in a characteristic value of the driving transistor included in each of the plurality of subpixels disposed in the display area.

If a plurality of fake subpixels are disposed in the non-display area, a deviation in characteristic value between reference transistors included in the plurality of fake subpixels may be smaller than a deviation in characteristic value between the driving transistors included in the plurality of subpixels disposed in the display area.

The self-emission display device may further comprise a memory storing an initial characteristic value of the driving transistor included in each of the plurality of subpixels.

The memory may store the initial characteristic value of the driving transistor included in each of the plurality of subpixels before the self-emission display device is shipped out.

The control module may control driving the fake subpixel based on the detection value, infer the initial characteristic values of the driving transistors included in all or some of the plurality of subpixels based on the detection value, change the initial characteristic value stored in the memory into an inferred initial characteristic value, or store the inferred initial characteristic values in the memory.

When the self-emission display device is shipped out, the initial characteristic value of the driving transistor may correspond to a characteristic value of the reference transistor.

During a sensing driving period for the fake subpixel, in a state in which a high potential power source voltage is applied to the first voltage node, a low potential power source voltage is applied to the second voltage node, and the bias voltage is applied to a gate node of the bias transistor, a voltage of the control signal and a voltage of the detection node may be elevated.

During the sensing driving period for the fake subpixel, the reference transistor and the bias transistor may be turned on.

The control module may control to elevate the voltage of the control signal until the voltage of the detection node is elevated to a specific voltage. If the elevated voltage of the detection node becomes the specific voltage, the control module may infer the initial characteristic values of the driving transistors included in all or some of the plurality of subpixels based on the elevated voltage of the control signal at a timing when the elevated voltage of the detection node becomes the specific voltage and store the inferred initial characteristic values in the memory.

Each of the plurality of subpixels may further include a scan transistor controlled by a scan signal and connected between a first node of the driving transistor and the data line, a sense transistor controlled by a sense signal and connected between a second node of the driving transistor and a reference voltage line, and a storage capacitor connected between the first node and second node of the driving transistor.

The self-emission display device may further include a sensing unit sensing a voltage of the reference voltage line connected with a first subpixel among the plurality of subpixels during a sensing driving period for the first subpixel, converting the sensed voltage into a digital sensing value, and outputting the digital sensing value, and a compensation unit calculating a compensation value for compensating for a luminance deviation between the first subpixel and another subpixel based on the sensing value.

Before a sensing driving period for the fake subpixel, a sensing driving period for the first subpixel may proceed. If the voltage of the reference voltage line connected with the first subpixel is elevated and saturated during the sensing driving period for the first subpixel, the sensing unit may sense the voltage of the reference voltage line, convert the sensed voltage into a digital sensing value, and output the digital sensing value. The voltage sensed by the sensing unit during the sensing driving period for the first subpixel may be the specific voltage.

The control module may infer an initial threshold voltage as the initial characteristic value of the driving transistor of the first subpixel based on the specific voltage or the elevated voltage of the detection node and the elevated voltage of the control signal at the timing when the elevated voltage of the detection node becomes the specific voltage and store the initial threshold voltage in the memory.

Based on the elevated voltage of the control signal at the timing when the elevated voltage of the detection node becomes the specific voltage, a sensing driving data voltage supplied to the first subpixel during the sending driving period for the first subpixel, and the threshold voltage of the driving transistor of the first subpixel sensed during the sending driving period for the first subpixel, the control module may infer an initial threshold voltage as the initial characteristic value of the driving transistor of the first subpixel and store the initial threshold voltage in the memory.

The bias voltage may be not less than a minimum voltage at which the bias transistor may be turned on and may be less than the voltage of the control signal.

The self-emission display device may further comprise one or more integrated circuits (ICs) in which the data driving circuit is implemented and a controller controlling the data driving circuit and the gate driving circuit.

The detection unit, along with a whole or part of the data driving circuit, may be included in one IC. The control module may be included in the controller.

A plurality of fake subpixels may be disposed in the non-display area. Each of the plurality of fake subpixels may be disposed in the non-display area, corresponding to one of a plurality of subpixel rows disposed in the display area or corresponding to one of a plurality of subpixel columns disposed in the display area.

A channel width-to-channel length ratio of the reference transistor included in the fake subpixel may be equal to a channel width-to-channel length ratio of the driving transistor included in each of the plurality of subpixels or may be different, within a preset range, from the channel width-to-channel length ratio of the driving transistor included in each of the plurality of subpixels.

According to an embodiment of the disclosure, there may be provided a self-emission display panel comprising a substrate including a display area and a non-display area around the display area, a subpixel disposed in the display area and including a light emitting element and a driving transistor, and a fake subpixel disposed in the non-display area and including a reference transistor and a bias transistor, the reference transistor controlled by a control signal and connected between a first voltage node and a detection node, and the bias transistor controlled by a bias voltage and connected between a second voltage node and the detection node.

The fake subpixel disposed in the non-display area may be a non-self-emission subpixel.

A variation in a characteristic value of the reference transistor included in the fake subpixel disposed in the non-display area may be smaller than a variation in a characteristic value of the driving transistor included in each of the plurality of subpixels disposed in the display area.

The self-emission display panel may further comprise a control signal line electrically connected with a gate node of the reference transistor and a bias signal line electrically connected with a gate node of the bias transistor.

According to the embodiments of the disclosure, there may be provided a self-emission display device and self-emission display panel that may precisely grasp variations in the characteristic values of the circuit elements in the subpixels after shipped and correctly compensate for luminance deviations between the subpixels by sensing and storing, in the memory, the initial characteristic values of circuit elements in the subpixels disposed in the self-emission display panel before the self-emission display panel is shipped.

According to the embodiments of the disclosure, there may be provided a self-emission display device and self-emission display panel that may restore the initial characteristic values of circuit elements in the subpixels disposed on the self-emission display panel when the initial characteristic values of the circuit elements in the subpixels are lost or damaged and may thus continuously perform precise compensation processing.

According to the embodiments of the disclosure, there may be provided a self-emission display device and self-emission display panel that includes an initial characteristic value restoration circuit capable of restoring the initial characteristic values of circuit elements in the subpixels disposed on the self-emission display panel when the initial characteristic values of the circuit elements are lost from the memory or damaged.

BRIEF DESCRIPTION OF DRAWINGS

The above and other objects, features, and advantages of the disclosure will be more clearly understood from the following detailed description, taken in conjunction with the accompanying drawings, in which.

DETAILED DESCRIPTION

Figure 1:
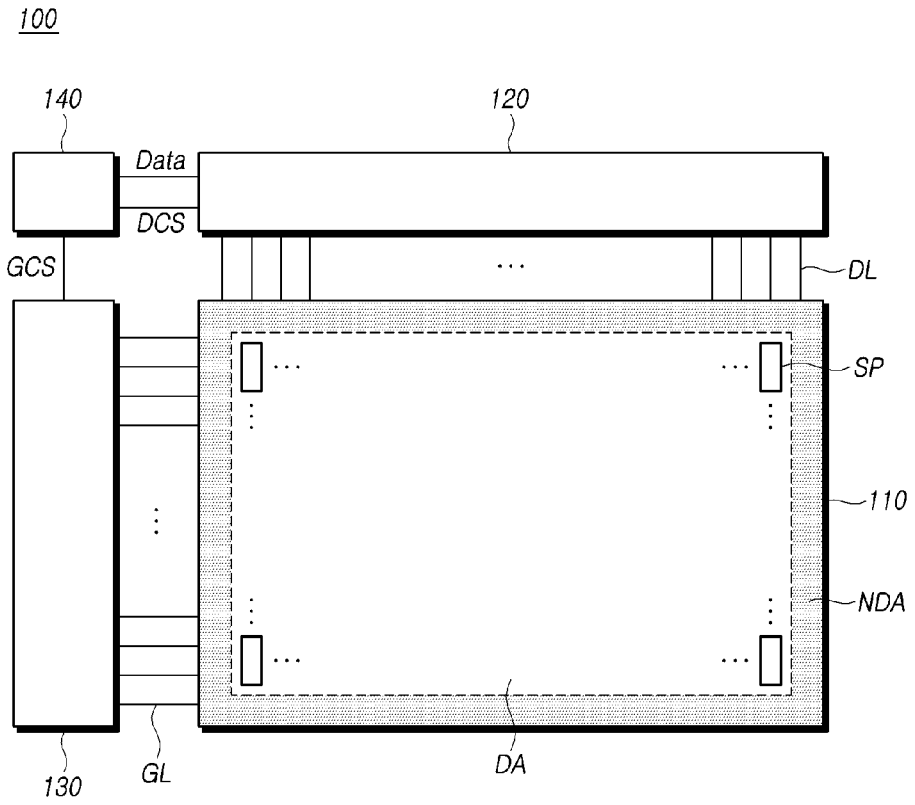
FIG. 1 is a view illustrating a configuration of a self-emission display device according to an embodiment of the disclosure.

In the following description of examples or embodiments of the disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the disclosure, detailed descriptions of well-known functions and components incorporated herein will be omitted when it is determined that the description may make the subject matter in some embodiments of the disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 is a view illustrating a system configuration of a self-emission display device 100 according to an embodiment of the disclosure.

Referring to FIG. 1, according to an embodiment, a self-emission display device 100 may include a self-emission display panel 110 and driving circuits for driving the self-emission display panel 110.

The driving circuits may include a data driving circuit 120 and a gate driving circuit 130, and may further include a controller 140 controlling the data driving circuit 120 and the gate driving circuit 130.

The self-emission display panel 110 may include signal lines, such as a plurality of data lines DL and a plurality of gate lines GL, and may include a plurality of sub-pixels SP.

The self-emission display panel 110 may include a display area DA in which images are displayed and a non-display area NDA in which no image is displayed.

In the self-emission display panel 110, a plurality of subpixels SP for displaying images are disposed in the display area DA, and the driving circuits 120, 130, and 140 may be electrically connected or disposed in the non-display area NDA. Further, pad units for connection of integrated circuits or a printed circuit may be disposed in the non-display area NDA.

The data driving circuit 120 is a circuit for driving the plurality of data lines DL, and may supply data signals to the plurality of data lines DL.

The gate driving circuit 130 is a circuit for driving the plurality of gate lines GL, and may supply gate signals to the plurality of gate lines GL.

The controller 140 may supply a data control signal DCS to the data driving circuit 120 to control the operation timing of the data driving circuit 120. The controller 140 may supply a gate control signal GCS for controlling the operation timing of the gate driving circuit 130 to the gate driving circuit 130.

The controller 140 may start scanning according to a timing implemented in each frame, convert input image data input from the outside into image data Data suited for the data signal format used in the data driving circuit 120, supply the image data Data to the data driving circuit 120, and control data driving at an appropriate time suited for scanning.

The controller 140 receives, from the outside (e.g., a host system), various timing signals including a vertical synchronization signal VSYNC, a horizontal synchronization signal HSYNC, an input data enable signal DE, and a clock signal, along with the input image data.

The controller 140 converts the input image data input from the outside to fit into the data signal format used in the data driving circuit 120 and outputs the converted-into image data Data. Further, to control the data driving circuit 120 and the gate driving circuit 130, the controller 140 receives the timing signals including the vertical sync signal VSYNC, the horizontal sync signal HSYNC, input data enable signal DE, and clock signal CLK, generates various control signals DCS and GCS, and outputs the control signals to the data driving circuit 120 and the gate driving circuit 130.

As an example, to control the gate driving circuit 130, the controller 140 outputs various gate control signals GCS including a gate start pulse GSP, a gate shift clock GSC, and a gate output enable signal (GOE).

The gate start pulse GSP controls the operation start timing of one or more gate driver integrated circuits constituting each gate driving circuit 130. The gate shift clock GSC is a clock signal commonly input to one or more gate driver integrated circuits and controls the shift timing of the scan signals (gate pulses). The gate output enable signal GOE designates timing information about one or more gate driver integrated circuits.

To control the data driving circuit 120, the controller 140 outputs various data control signals DCS including, e.g., a source start pulse SSP, a source sampling clock SSC, and a source output enable signal (SOE).

The source start pulse SSP controls the data sampling start timing of one or more source driver integrated circuits constituting the data driving circuit 120. The source sampling clock SSC is a clock signal for controlling the sampling timing of data in each source driver integrated circuit. The source output enable signal SOE controls the output timing of the data driving circuit 120.

The controller 140 may be implemented as a separate component from the data driving circuit 120, or the controller 140, along with the data driving circuit 120, may be implemented as an integrated circuit.

The data driving circuit 120 receives the image data Data from the controller 140 and supply data voltage to the plurality of data lines DL, thereby driving the plurality of data lines DL. Here, data driving circuit 120 is also referred to as a "source driving circuit."

The data driving circuit 120 may include one or more source driver integrated circuit (SDICs).

Each source driver integrated circuit (SDIC) may include a shift register, a latch circuit, a digital-to-analog converter (DAC), and an output buffer. In some cases, each source driver integrated circuit (SDIC) may further include an analog-digital converter ADC.

For example, each source driver integrated circuit (SDIC) may be connected with the self-emission display panel 110 by a tape automated bonding (TAB) method or connected to a bonding pad of the self-emission display panel 110 by a chip on glass (COG) or chip on panel (COP) method or may be implemented by a chip on film (COF) method and connected with the self-emission display panel 110.

The gate driving circuit 130 may output a gate signal of a turn-on level voltage or a gate signal of a turn-off level voltage according to the control of the controller 140. The gate driving circuit 130 may sequentially drive the plurality of gate lines GL by sequentially supplying gate signals of the turn-on level voltage to the plurality of gate lines GL.

The gate driving circuit 130 may be connected with the self-emission display panel 110 by TAB method or connected to a bonding pad of the self-emission display panel 110 by a COG or COP method or may be connected with the self-emission display panel 110 according to a COF method. Alternatively, the gate driving circuit 130 may be formed in the non-display area NDA of the self-emission display panel 110 in a gate in panel (GIP) type.

When a specific gate line GL is opened by the gate driving circuit 130, the data driving circuit 120 may convert the image data Data received from the controller 140 into an analog data voltage and supply it to the plurality of data lines DL.

The data driving circuit 120 may be connected with one side (e.g., an upper or lower side) of the self-emission display panel 110. Depending on the driving scheme or the panel design scheme, the data driving circuit 120 may be connected with both sides (e.g., upper and lower sides) of the self-emission display panel 110, or two or more of the four sides of the self-emission display panel 110.

The gate driving circuit 130 may be connected with one side (e.g., a left side or right side) of the self-emission display panel 110. Depending on the driving scheme or the panel design scheme, the gate driving circuit 130 may be connected with both sides (e.g., left side and right side) of the self-emission display panel 110, or two or more of the four sides of the self-emission display panel 110.

The controller 140 may be a timing controller used in typical display technology, a control device that performs other control functions as well as the functions of the timing controller, or a control device other than the timing controller, or may be a circuit in the control device. The controller 140 may be implemented as various circuits or electronic components, such as an integrated circuit (IC), a field programmable gate array (FPGA), an application specific integrated circuit (ASIC), or a processor.

The controller 140 may be mounted on a printed circuit board or a flexible printed circuit and may be electrically connected with the data driving circuit 120 and the gate driving circuit 130 through the printed circuit board or the flexible printed circuit.

The controller 140 may transmit/receive signals to/from the data driving circuit 120 according to one or more predetermined interfaces. The interface may include, e.g., a low voltage differential signaling (LVDS) interface, an EPI interface, and a serial peripheral interface (SPI).

The controller 140 may include storage, such as one or more registers.

According to an embodiment, the self-emission display device 100 may be a self-emission display, such as an organic light emitting diode (OLED) display, a quantum dot display, or a micro light emitting diode (LED) display.

According to an embodiment, when the self-emission display device 100 is an OLED display, each subpixel SP may include an organic light emitting diode (OLED), which is self-emission, as a light emitting element. According to an embodiment, when the self-emission display device 100 is a quantum dot display, each subpixel SP may include a light emitting element formed of a quantum dot, which is a self-emission semiconductor crystal. According to an embodiment, when the self-emission display device 100 is a micro LED display, each subpixel SP may include a micro light emitting diode), which is self-emission and formed of an inorganic material, as a light emitting element.

Figure 2:
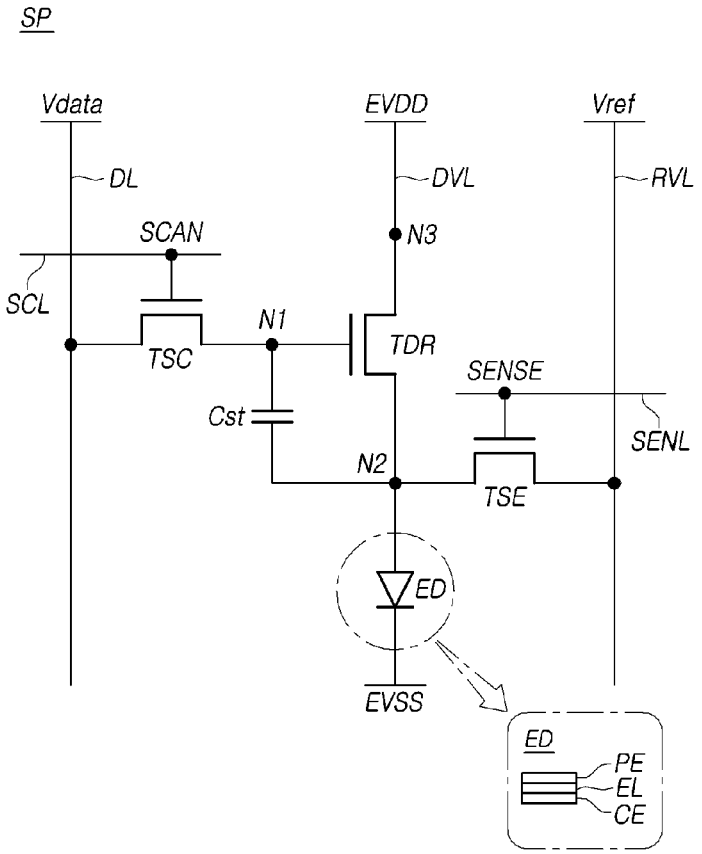
FIG. 2 is a view illustrating an equivalent circuit of a sub-pixel of a self-emission display device according to an embodiment of the disclosure.

FIG. 2 is a view illustrating an equivalent circuit of a sub-pixel of a self-emission display device 100 according to an embodiment of the disclosure.

Referring to FIG. 2, according to an embodiment, each of a plurality of subpixels SP disposed on a self-emission display panel 110 of a self-emission display device 100 may include a light emitting element ED, a driving transistor TDR, a scan transistor TSC, a sense transistor TSE, and a storage capacitor Cst. If the subpixel SP includes the three transistors TDR, TSC, and TSE and one capacitor Cst, the subpixel SP may be referred to as having a 3T (Transistor) 1C (Capacitor) structure.

The light emitting element ED may include an anode electrode and a cathode electrode, and a light emitting layer EL positioned between the anode electrode and the cathode electrode. Here, the anode electrode may be a pixel electrode PE included in each subpixel SP. The cathode electrode may be a common electrode CE common to all the subpixels SP. For example, the light emitting element ED may be an organic light emitting diode (OLED), a light emitting diode (LED), or a quantum dot light emitting element.

The driving transistor TDR is a transistor for driving the light emitting element ED, and may include a first node N1, a second node N2, and a third node N3.

The first node N1 of the driving transistor TDR may be a gate node of the driving transistor TDR, and may be electrically connected with a source node or a drain node of the scan transistor TSC. The second node N2 of the driving transistor TDR may be a source node or a drain node of the driving transistor TDR, and may be electrically connected with a source node or a drain node of the sense transistor TSE and may also be electrically connected with the pixel electrode PE of the light emitting element ED. The third node N3 of the driving transistor TDR may be electrically connected with a driving voltage line DVL supplying a driving voltage EVDD.

The scan transistor TSC may be controlled by the scan signal SCAN and may be connected between the first node N1 of the driving transistor TDR and the data line DL. In other words, the scan transistor TSC may be turned on or off according to the scan signal SCAN supplied from the scan signal line SCL, which is a type of the gate line GL, controlling the connection between the data line DL and the first node N1 of the driving transistor TDR.

The scan transistor TSC may be turned on by the scan signal SCAN having a turn-on level voltage and transfer the data voltage Vdata supplied from the data line DL to the first node N1 of the driving transistor TDR.

The sense transistor TSE may be controlled by the sense signal SENSE and may be connected between the second node N2 of the driving transistor TDR and the reference voltage line RVL. In other words, the sense transistor TSE may be turned on or off according to the sense signal SENSE supplied from the sense signal line SENL, which is another type of the gate line GL, controlling the connection between the reference voltage line RVL and the second node N2 of the driving transistor TDR.

The sense transistor TSE may be turned on by the sense signal SENSE having a turn-on level voltage and transfer a reference voltage Vref supplied from the reference voltage line RVL to the second node N2 of the driving transistor TDR.

The sense transistor TSE may be turned on by the sense signal SENSE having a turn-on level voltage and transfer the voltage of the second node N2 of the driving transistor TDR to the reference voltage line RVL.

The function in which the sense transistor TSE transfers the voltage of the second node N2 of the driving transistor TDR to the reference voltage line RVL may be used upon driving to sense the characteristic value of the subpixel SP. In this case, the voltage transferred to the reference voltage line RVL may be a voltage for calculating the characteristic value of the subpixel SP or a voltage reflecting the characteristic value of the subpixel SP.

In one embodiment, the characteristic value of the subpixel SP may be a characteristic value of the driving transistor TDR or the light emitting element ED. The characteristic value of the driving transistor TDR may include a threshold voltage and mobility of the driving transistor TDR. The characteristic value of the light emitting element ED may include a threshold voltage of the light emitting element ED.

Each of the driving transistor TDR, the scan transistor TSC, and the sense transistor TSE may be an n-type transistor or a p-type transistor. In the disclosure, for convenience of description, each of the driving transistor TDR, the scan transistor TSC, and the sense transistor TSE is an n-type transistor.

The storage capacitor Cst may be electrically connected between the first node N1 and second node N2 of the driving transistor TDR. The storage capacitor Cst is charged with the quantity of electric charge corresponding to the voltage difference between both ends thereof and serves to maintain the voltage difference between both ends for a predetermined frame time. Accordingly, during the predetermined frame time, the corresponding subpixel SP may emit light.

The storage capacitor Cst is not a parasitic capacitor (e.g., gate-source parasitic capacitor Cgs or gate-drain parasitic capacitor Cgd) which is an internal capacitor existing between the gate node and the source node (or drain node) of the driving transistor TDR, but may be an external capacitor intentionally designed outside the driving transistor TDR.

The scan signal line SCL and the sense signal line SENL may be different gate lines GL. In this case, the scan signal SCAN and the sense signal SENSE may be separate gate signals, and the on-off timings of the scan transistor TSC and the on-off timings of the sense transistor TSE in one subpixel SP may be independent. In other words, the on-off timings of the scan transistor TSC and the on-off timings of the sense transistor TSE in one subpixel SP may be the same or different.

Alternatively, the scan signal line SCL and the sense signal line SENL may be the same gate line GL. In other words, the gate node of the scan transistor TSC and the gate node of the sense transistor TSE in one subpixel SP may be connected with one gate line GL. In this case, the scan signal SCAN and the sense signal SENSE may be the same gate signal, and the on-off timings of the scan transistor TSC and the on-off timings of the sense transistor TSE in one subpixel SP may be identical.

Figure 3:
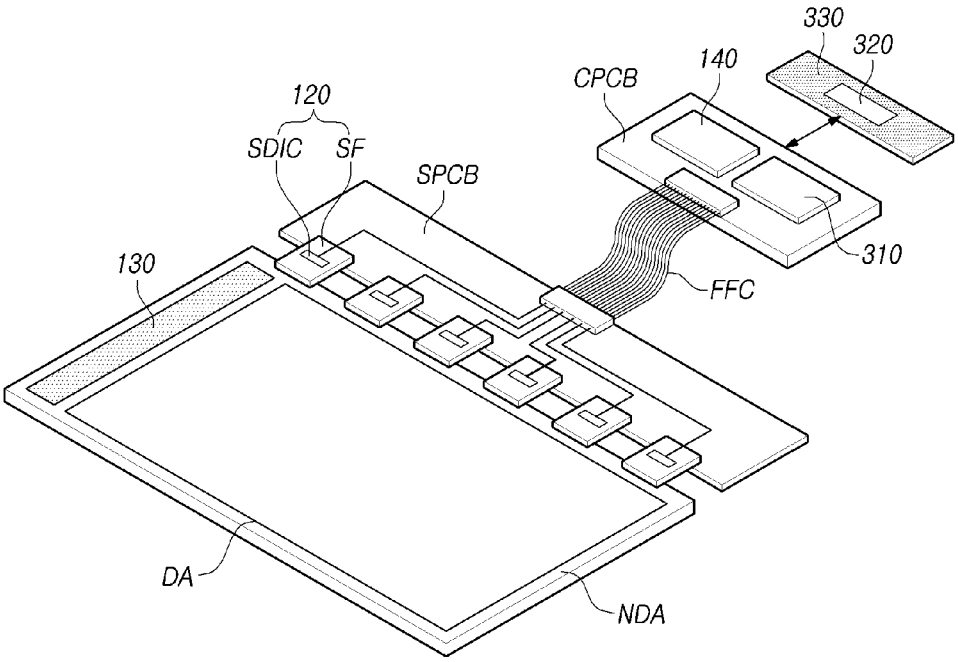
FIG. 3 is a view illustrating an example of implementation of a self-emission display device according to an embodiment of the disclosure.

FIG. 3 is a view illustrating an example of implementation of a self-emission display device 100 according to an embodiment of the disclosure.

Referring to FIG. 3, the self-emission display panel 110 may include a display area DA in which images are displayed and a non-display area NDA in which no image is displayed.

Referring to FIG. 3, when a data driving circuit 120 includes one or more source driver integrated circuits SDIC and is implemented in a chip-on-film (COF) type, each source driver integrated circuit SDIC may be mounted on a circuit film SF connected to the non-display area NDA of the self-emission display panel 110.

Referring to FIG. 3, a gate driving circuit 130 may be implemented in a gate in panel (GIP) type. In this case, the gate driving circuit 130 may be formed in the non-display area NDA of the self-emission display panel 110. Unlike FIG. 3, the gate driving circuit 130 may be implemented in a chip on film (COF) type.

The self-emission display device 100 may include at least one source printed circuit board SPCB for circuit connection between one or more source driver integrated circuits SDIC and other devices and a control printed circuit board CPCB for mounting control components and various electric devices.

The source driver integrated circuit SDIC-packed film SF may be connected to at least one source printed circuit board SPCB. In other words, one side of the source driver integrated circuit SDIC-packed film SF may be electrically connected with the self-emission display panel 110, and the opposite side thereof may be electrically connected with the source printed circuit board SPCB.

A controller 140 and a power management integrated circuit (PMIC) 310 may be mounted on the control printed circuit board CPCB.

The controller 140 may perform overall control functions related to driving of the self-emission display panel 110, and may control operations of the data driving circuit 120 and the gate driving circuit 130.

The power management integrated circuit 310 may supply various voltages or currents to the data driving circuit 120 and the gate driving circuit 130 or may control various voltages or currents to be supplied thereto.

At least one source printed circuit board SPCB and the control printed circuit board CPCB may be circuit-connected through at least one connection member. Here, the connection member may be, for example a flexible printed circuit (FPC) or a flexible flat cable (FFC). At least one source printed circuit board SPCB and control printed circuit board CPCB may be integrated into one printed circuit board.

The self-emission display device 100 may further include a set board 330 electrically connected with the control printed circuit board CPCB. This set board 330 may also be referred to as a power board. A main power management circuit 320 for managing the overall power of the self-emission display device 100 may be disposed on the set board 330.

The power management integrated circuit 310 is a circuit that manages power for a display module including the self-emission display panel 110 and its driving circuits 120, 130, and 140, and the main power management circuit 320 is a circuit that manages the power of the whole including the display module, and may interwork with the power management integrated circuit 310.

According to an embodiment, the driving transistor TDR and/or the light emitting element ED included in each of the plurality of subpixels SP disposed on the self-emission display panel 110 of the self-emission display device 100 may have intrinsic characteristic values. For example, the intrinsic characteristic values of the driving transistor TDR may include a threshold voltage and mobility. The intrinsic characteristic values of the light emitting element ED may include, for example a threshold voltage.

The characteristic values of the driving transistor TDR included in each of the plurality of subpixels SP may vary over the driving time.

All of the plurality of subpixels SP do not have the same driving time. In other words, the driving time of some of the plurality of subpixels SP may be different from the driving time of the rest.

Accordingly, the characteristic values of the respective driving transistors TDR of the plurality of subpixels SP are not all the same. In other words, the characteristic values of the driving transistors TDR of some subpixels SP among the plurality of subpixels SP may be different from the characteristic values of the driving transistors TDR of other subpixels SP.

Due to deviations in characteristic values between the plurality of driving transistors TDR disposed on the self-emission display panel 110, luminance deviations may occur between the plurality of subpixels SP disposed on the self-emission display panel 110. In other words, non-uniform luminance may occur in the self-emission display panel 110.

Similar to the deviations in characteristic values between the plurality of driving transistors TDR disposed on the self-emission display panel 110, deviations in characteristic values between the plurality of light emitting elements ED disposed on the self-light emitting display panel 110 may also exist. As a result, luminance deviations may occur between the plurality of subpixels SP disposed on the self-emission display panel 110. In other words, non-uniform luminance may occur in the self-emission display panel 110.

According to an embodiment, the self-emission display device 100 may provide a compensation function for reducing deviations in characteristic value between the plurality of driving transistors TDR disposed on the self-emission display panel 110 and deviations in characteristic value between the plurality of light emitting elements ED disposed on the self-emission display panel 110.

Figure 4:
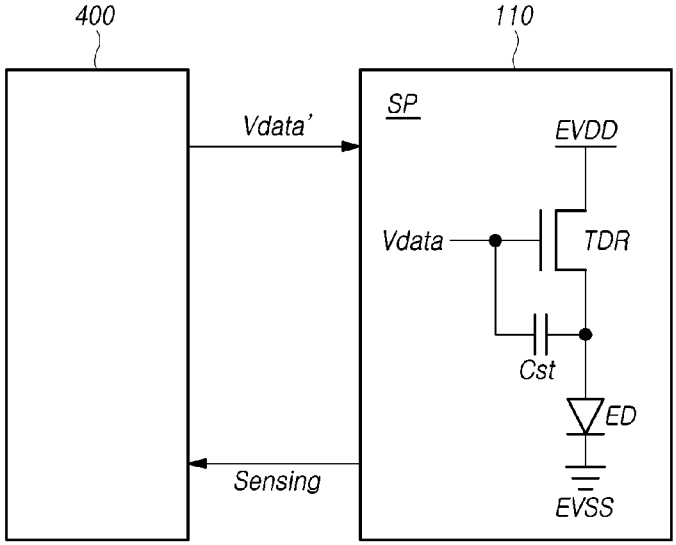
FIG. 4 is a view illustrating an external compensation method of a self-emission display device according to an embodiment of the disclosure.

FIG. 4 is a view illustrating a compensation method of a self-emission display device 100 according to an embodiment of the disclosure.

According to an embodiment, the self-light emitting display device 100 may provide compensation functions using an external compensation method and an internal compensation method to reduce luminance non-uniformity of the self-emission display panel 110. The external compensation method provides a compensation function using a compensation circuit provided outside the self-emission display panel 110, and the internal compensation method provides a compensation function without using a compensation circuit outside the self-emission display panel 110.

Referring to FIG. 4, according to an embodiment, the self-light emitting display device 100 may include an external compensation circuit 400 to provide a compensation function using the external compensation method.

Referring to FIG. 4, the external compensation circuit 400 may sense the self-emission display panel 110 and supply a data voltage Vdata', which is changed via data compensation processing using the result of sensing, to the self-emission display panel 110.

The external compensation circuit 400 may sense the voltage of the reference voltage line RVL, which reflects a characteristic value (e.g., threshold voltage or mobility) of the driving transistor TDR in the subpixel SP of the self-emission display panel 110 via sensing driving of the self-emission display panel 110.

The external compensation circuit 400 may grasp the characteristic values (e.g., threshold voltage or mobility) of the driving transistors TDR based on the sensed voltage of the reference voltage line RVL, grasp the deviation in characteristic value between the driving transistors TDR, and calculate a compensation value for reducing or removing the deviation in characteristic value between the driving transistors TDR.

The external compensation circuit 400 may change data to be supplied to the corresponding subpixel SP based on the calculated compensation value and may supply the changed data to the data driving circuit 120. The data driving circuit 120 may convert the changed data into data voltage Vdata', which corresponds to an analog voltage, and supply the data voltage Vdata' to the corresponding subpixel SP.

Figure 5:
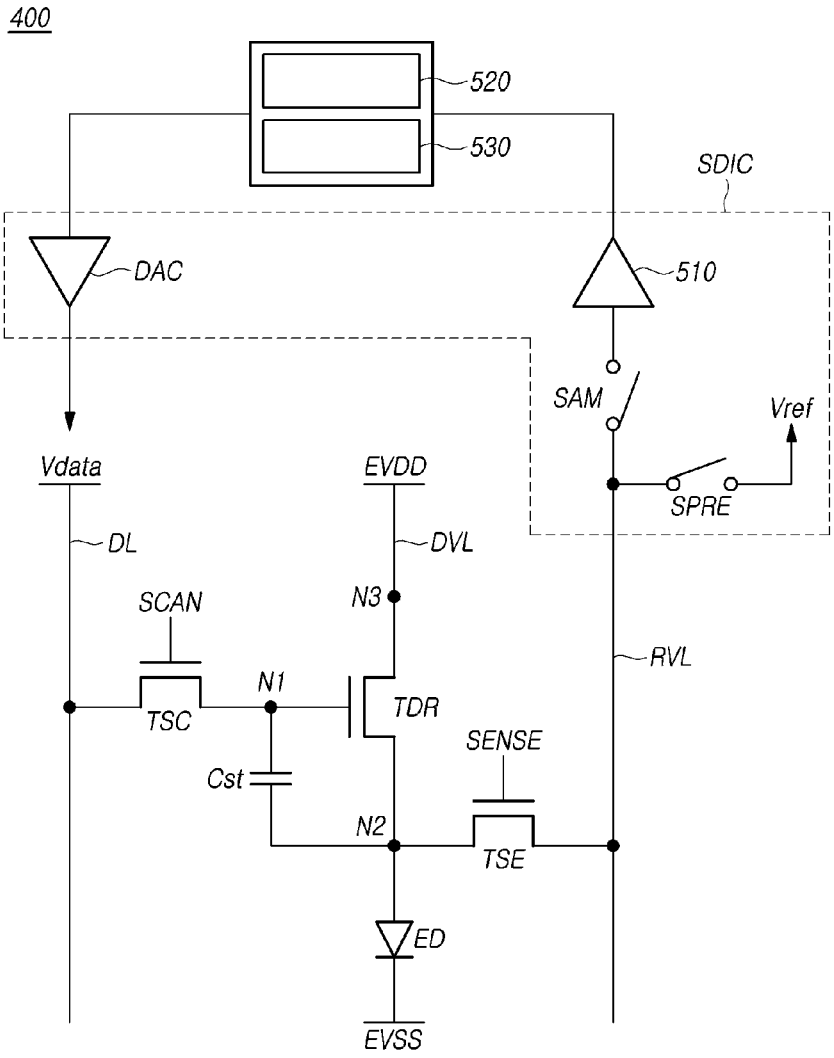
FIG. 5 is a view illustrating an external compensation circuit for a self-emission display device according to an embodiment of the disclosure.

FIG. 5 is a view illustrating an external compensation circuit 400 of a self-emission display device 100 according to an embodiment.

According to an embodiment, the external compensation circuit 400 of the self-emission display device 100 may compensate for deviations in characteristic value between the driving transistors TDR and may compensate for deviations in characteristic value between the light emitting elements ED.

Referring to FIG. 5, according to an embodiment, the external compensation circuit 400 of the self-emission display device 100 may include a sensing unit 510, a compensation unit 520, and a memory 530.

The sensing unit 510 may sense the voltage of the reference voltage line RVL to grasp (e.g., determine) the characteristic value of the subpixel SP and may generate and output sensing data based on the sensed voltage. For example, the sensing unit 510 may convert the sensed voltage into a digital value and generate sensing data including a sensing value corresponding to the digital value.

The compensation unit 520 may grasp the characteristic value of each subpixel SP using the sensing data output from the sensing unit 510 and perform a compensation process for compensating for the deviation in characteristic value between the subpixels SP based thereupon.

Here, the characteristic value of the subpixel SP may be the threshold voltage or mobility of the driving transistor TDR in the subpixel SP or the threshold voltage of the light emitting element ED in the subpixel SP according to one embodiment. The deviation in characteristic value between the subpixels SP may be deviation in threshold voltage or mobility between the driving transistors DRT or deviation in threshold voltage between the light emitting elements ED.

The compensation unit 520 may calculate a compensation value for each of the plurality of subpixels SP by performing the compensation process and store the calculated compensation value in the memory 530.

More specifically, the compensation unit 520 may grasp characteristic values (e.g., threshold voltage or mobility) or changes in the characteristic value of the driving transistor TDR based on the sensing data or grasp deviations in characteristic value between the driving transistors DRT, calculate compensation values for reducing or removing the deviations in characteristic value between the driving transistors TDR, and store the calculated compensation values in the memory 530.

The compensation unit 520 may grasp the characteristic value (e.g., threshold voltage or mobility) of the driving transistor TDR based on the sensing data and compare the grasped characteristic value of the driving transistor TDR with an initial characteristic value of the driving transistor TDR stored in the memory 530, thereby grasping a change in the characteristic value of the driving transistor TDR.

The change in the characteristic value of the driving transistor TDR is information reflecting degradation information for the driving transistor TDR. The larger change in the characteristic value of the driving transistor TDR may mean the larger degradation of the driving transistor TDR.

The initial characteristic value of the driving transistor TDR stored in the memory 530 may be a characteristic value sensed for the driving transistor TDR through a sensing step during the manufacturing process of the self-emission display panel 110.

The compensation unit 520 or the controller 140 may change data to be supplied to the corresponding subpixel SP based on the calculated compensation value and may supply the changed data to the data driving circuit 120.

The data driving circuit 120 may convert the changed data, which is digital data, into a data voltage Vdata, which is an analog voltage, through a digital-to-analog converter (DAC) and supply the data voltage Vdata to the corresponding subpixel SP.

According to an embodiment, the external compensation circuit 400 of the self-emission display device 100 may further include an initialization switch SPRE and a sampling switch SAM.

The initialization switch SPRE may control whether to connect the reference voltage line RVL and the reference voltage supply node, thereby controlling whether to apply the reference voltage Vref to the reference voltage line RVL. The sampling switch SAM may control whether to connect the reference voltage line RVL and the sensing unit 510.

The initialization switch SPRE is a switch to control the voltage application state of the second node N2 of the driving transistor TDR such that the second node N2 of the driving transistor TDR in the subpixel SP is in a specific state.

The second node N2 of the driving transistor TDR may have the same electrical state as the pixel electrode PE of the light emitting element ED.

The above-mentioned specific state of the second node N2 of the driving transistor TDR may mean a voltage state in which the second node N2 of the driving transistor TDR reflects the characteristic value of the subpixel SP. For example, the characteristic value of the subpixel SP may be the threshold voltage or mobility of the driving transistor TDR, or the threshold voltage of the light emitting element ED.

When the initialization switch SPRE is turned on, the reference voltage Vref is supplied to the reference voltage line RVL, and the reference voltage Vref supplied to the reference voltage line RVL may be applied to the second node N2 of the driving transistor TDR through the turned-on sense transistor TSE.

The sampling switch SAM is turned on to electrically connect the reference voltage line RVL and the sensing unit 510.

When the voltage state of the reference voltage line RVL or the second node N2 of the driving transistor TDR in the subpixel SP becomes a voltage state reflecting the characteristic value of the subpixel SP, the sampling switch SAM may be turned on. When the sampling switch SAM is turned on, the sensing unit 510 may be electrically connected with the reference voltage line RVL to sense the voltage of the reference voltage line RVL.

In a case where the sense transistor TSE has been turned on when the sensing unit 510 senses the voltage of the reference voltage line RVL, if the resistance component of the driving transistor TDR may be ignored, the voltage sensed by the sensing unit 510 may correspond to the voltage of the second node N2 of the driving transistor TDR.

The voltage sensed by the sensing unit 510 may be the voltage of the reference voltage line RVL or the voltage of the second node N2 of the driving transistor TDR.

If a line capacitor is present on the reference voltage line RVL, the voltage sensed by the sensing unit 510 may be a voltage charged to the line capacitor on the reference voltage line RVL. Here, the reference voltage line RVL is also referred to as a sensing line.

For example, the voltage sensed by the sensing unit 510 may be a voltage value (e.g., Vdata-Vth or Vdata-ΔVth, where Vdata is a data voltage for sensing driving) including the threshold voltage Vth or a threshold voltage change ΔVth of the driving transistor TDR or a voltage value for sensing the mobility of the driving transistor TDR.

As an example, one reference voltage line RVL may be disposed every subpixel column or every two or more subpixel columns.

For example, if one pixel is composed of 4 subpixels (a red subpixel, a white subpixel, a green subpixel, and a blue subpixel), one reference voltage line RVL may be disposed every pixel column including four subpixel columns (a red subpixel column, a white subpixel column, a green subpixel column, and a blue subpixel column).

The sensing unit 510 may be implemented to include at least one analog-to-digital converter (ADC).

All or some of the sensing unit 510, the initialization switch SPRE, and the sampling switch SAM may be included in the source driver integrated circuit SDIC included in the data driving circuit 120 and, in some cases, may be included outside the source driver integrated circuit SDIC.

The compensation unit 520 may be included in or outside the controller 140.

As described above, the memory 530 may store sensing data (including sensing values for a plurality of subpixels SP) output from the sensing unit 510 and compensate for the compensation value for each subpixel SP.

The memory 530 may also store an initial characteristic value of each driving transistor TDR. The initial characteristic value of the driving transistor TDR is a threshold voltage or mobility. Before the self-emission display device 100 is shipped, the memory 530 may store the initial characteristic values of the driving transistors TDR.

In other words, the characteristic values of the driving transistors TDR may be sensed through a sensing step during the manufacturing process of the self-emission display panel 110, and the sensed characteristic values, as initial characteristic values, may be stored in the memory 530. The self-emission display device 100 may be shipped, with the initial characteristic values stored in the memory 530.

Figure 6:
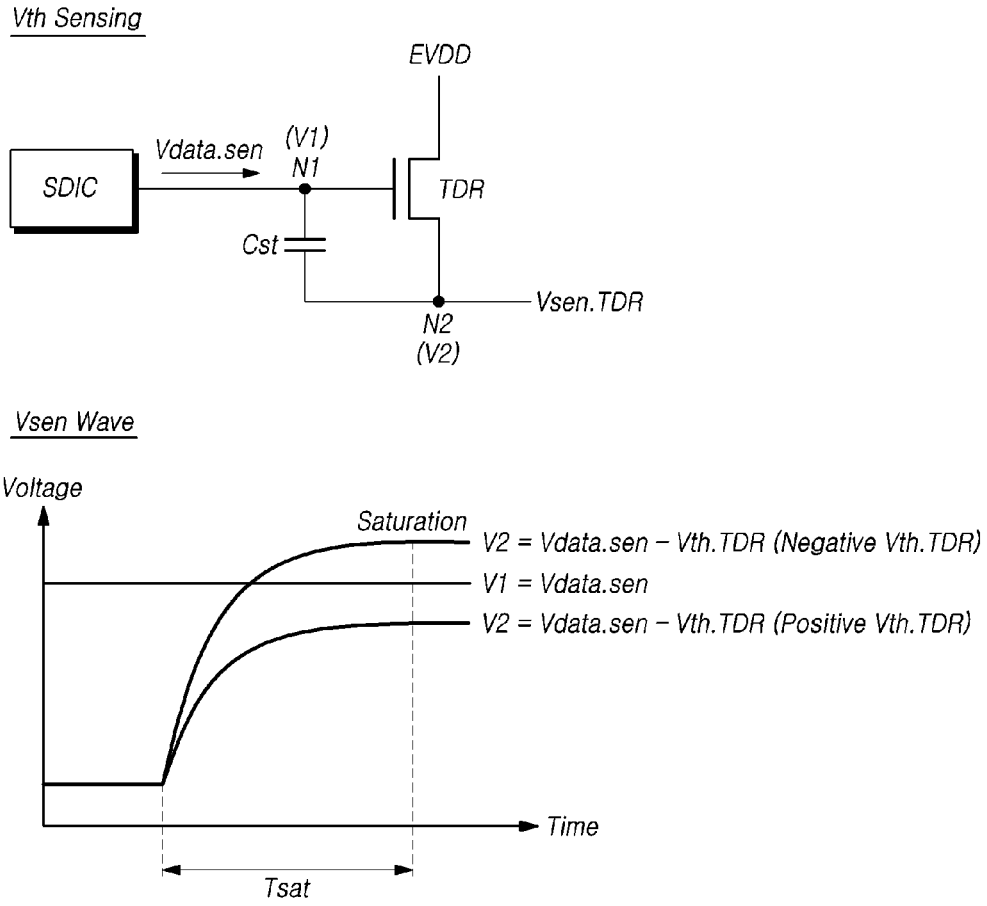
FIG. 6 is a view illustrating an example of threshold voltage sensing driving of a self-emission display device according to an embodiment of the disclosure.

FIG. 6 is a view illustrating an example of threshold voltage sensing driving of a self-emission display device 100 according to an embodiment of the disclosure.

The threshold voltage sensing driving for the driving transistor TDR may be performed through a sensing process including an initialization step, a tracking step, and a sampling step. The tracking step and the sampling step are collectively referred to as a sensing step.

The initialization step is the step of initializing the first node N1 and the second node N2 of the driving transistor TDR. For example, in the initialization step, the scan transistor TSC and the sense transistor TSE may be turned on, and the initialization switch SPRE may be turned on.

Accordingly, the first node N1 and the second node N2 of the driving transistor TDR are initialized as a threshold voltage sensing driving data voltage Vdata.sen and a reference voltage Vref, respectively, (V1=Vdata.sen, V2=Vref).

The tracking step electrically floats the second node N2 of the driving transistor TDR and changes the voltage V2 of the second node N2 of the driving transistor TDR until the second node N2 of the driving transistor TDR becomes a voltage state reflecting the threshold voltage Vth.TDR of the driving transistor TDR or its change. In other words, the tracking step is the step of tracking the voltage of the second node N2 of the driving transistor TDR that may reflect the threshold voltage or a change thereof.

In the tracking step, the initialization switch SPRE is turned off or the sense transistor TSE is turned off, so that the second node N2 of the driving transistor TDR is floated.

Accordingly, the voltage V2 of the second node N2 of the driving transistor TDR rises.

The rise of voltage V2 of the second node N2 of the driving transistor TDR gradually slows down, and the voltage V2 is then saturated.

Here, the time Tsat taken for the voltage V2 of the second node N2 of the driving transistor TDR to be elevated and then saturated is a time taken for the threshold voltage Vth.TDR of the driving transistor TDR or its change to be reflected to the second node N2 of the driving transistor TDR and controls the sensing time.

The saturated voltage of the second node N2 of the driving transistor TDR may correspond to the difference (Vdata.sen-Vth.TDR) between the sensing driving data voltage Vdata.sen and the threshold voltage Vth.TDR or the difference (Vdata.sen-ΔVth.TDR) between the data voltage Vdata.sen and the threshold voltage deviation ΔVth.TDR.

In other words, in a case where the second node N2 of the driving transistor TDR is the source node, in the tracking step, the voltage of the second node N2 of the driving transistor TDR is changed until it becomes the difference between the voltage Vdata.sen of the first node N1 of the driving transistor TDR and the threshold voltage Vth.TDR.

Here, if the voltage of the second node N2 of the driving transistor TDR becomes the difference between the voltage Vdata.sen of the first node N1 of the driving transistor TDR and the threshold voltage Vth.TDR, the driving transistor TDR is turned off. Accordingly, in the tracking step, the voltage of the second node N2 of the driving transistor TDR is changed until the driving transistor TDR is turned off.

In sum, in the tracking step, when the voltage of the second node N2 of the driving transistor TDR is saturated, the voltage V1 of the first node N1 of the driving transistor TDR is the sensing driving data voltage Vdata.sen, and the voltage V2 of the second node N2 of the driving transistor TDR is the sensing driving data voltage Vdata.sen less the threshold voltage Vth.TDR of the driving transistor TDR (i.e., V2=Vdata.sen−Vth.TDR).

If the voltage V2 of the second node N2 of the driving transistor TDR is saturated, the sampling step may be performed.

The sampling step is the step of measuring the voltage (Vdata.sen-Vth, Vdata.sen-ΔVth) reflecting the threshold voltage Vth or its change and is a step in which the sensing unit 510 senses the voltage of the reference voltage line RVL (which may be the voltage of the second node N2 of the driving transistor TDR).

In the sampling step, the sampling switch SAM is turned on, so that the sensing unit 510 is connected with the reference voltage line RVL and may sense the voltage of the reference voltage line RVL (which may be the voltage of the second node N2 of the driving transistor TDR).

In the sampling step, the voltage Vsen.TDR sensed by the sensing unit 510 is the saturated voltage (V2=Vdata.sen−Vth.TDR) of the second node N2 of the driving transistor TDR, and may be the data voltage Vdata.sen less the threshold voltage Vth (Vdata.sen-Vth) or the data voltage Vdata.sen less the threshold voltage deviation ΔVth (Vdata.sen-ΔVth). Here, Vth may be a positive threshold voltage or a negative threshold voltage.

As described above, the way of figuring out the threshold voltage Vth.TDR by changing the voltage of the second node N2 of the driving transistor TDR to differ from the voltage V1 of the first node N1 of the driving transistor TDR by a predetermined voltage value is referred to as a source follower scheme.

By the above-described threshold voltage sensing driving, the sensing unit 510 converts the voltage Vsen.TDR sensed for threshold voltage sensing into a digital value and generates and outputs sending data including the digital value (sensing value).

The sensing data output from the sensing unit 510 may be provided to the compensation unit 520.

The compensation unit 520 may grasp the threshold voltage or a change in the threshold voltage of the driving transistor TDR in the subpixel SP based on the sensing data provided from the sensing unit 510, and perform the compensation process.

Here, the change in the threshold voltage of the driving transistor TDR may mean the difference between the threshold voltage figured out via the current sensing value and the initial threshold voltage stored in the memory 530.

The compensation unit 520 calculates a compensation value for compensating for the deviation in threshold voltage between the driving transistors TDR through the compensation process and may store the calculated compensation value in the memory 530 or change the image data Data using the calculated compensation value.

The compensation unit 420 may change the image data Data through the threshold voltage compensation process and supply the changed data to the data driving circuit 120.

Accordingly, the data driving circuit 120 converts the data changed by the compensation unit 420 into a data voltage Vdata through a digital-to-analog converter (DAC) and supplies it to the corresponding subpixel SP. By so doing, it is possible to indeed achieve compensation for the subpixel characteristic value (threshold voltage compensation or mobility compensation).

As compensation for the subpixel characteristic value is performed, deviation in luminance may be reduced or prevented, enhancing image quality.

If the compensation process is performed according to the above-described threshold voltage sensing driving, the threshold voltage Vth.TDR is canceled off in the equation for the current of the driving transistor TDR to determine the current of the light emitting element ED, so that a current irrelevant to the threshold voltage Vth.TDR of the driving transistor TDR flows through the light emitting element ED. Accordingly, deviation in the luminance of the light emitting element ED may be reduced.

Meanwhile, a pre-shipment compensation process (also referred to as initial compensation) is performed to measure the initial characteristic values (e.g., the initial threshold voltages or initial mobility of the driving transistors DRT) of the driving transistors DRT disposed on the self-emission display panel 110 and store the initial characteristic values in the memory 530.

The external compensation circuit may use initial characteristic values (e.g., initial threshold voltages or initial mobility) stored in the memory 530 to perform compensation.

In the external compensation method, the compensation unit 520 may compare the threshold voltage Vth.TDR sensed via sensing driving on the self-emission display panel 110 with the initial threshold voltage stored in the memory 530, calculate a variation relative to the initial threshold voltage, and calculate compensation data (compensation value) based thereupon.

It may take a significant time to sense the threshold voltages of the driving transistors DRT disposed on the self-emission display panel 110. Thus, initial compensation, which senses the initial threshold voltages of the driving transistors DRT and store them in the memory 530, may be time-consuming, reducing yield.

Meanwhile, the memory 530 may lose stored data due to electrical errors, human errors, or other various causes, which may have a significant adverse effect on panel compensation. Therefore, if the pre-measured initial threshold voltages are erased from the memory 530 or damaged before shipment, initial compensation needs to be carried out again. Therefore, the product needs to be collected for customer service.

According to an embodiment, the self-emission display device 100 may provide a method for restoring the initial characteristic values (initial threshold voltages or initial mobility) of the driving transistors DRT and an initial characteristic value restoration circuit.

Figure 7:
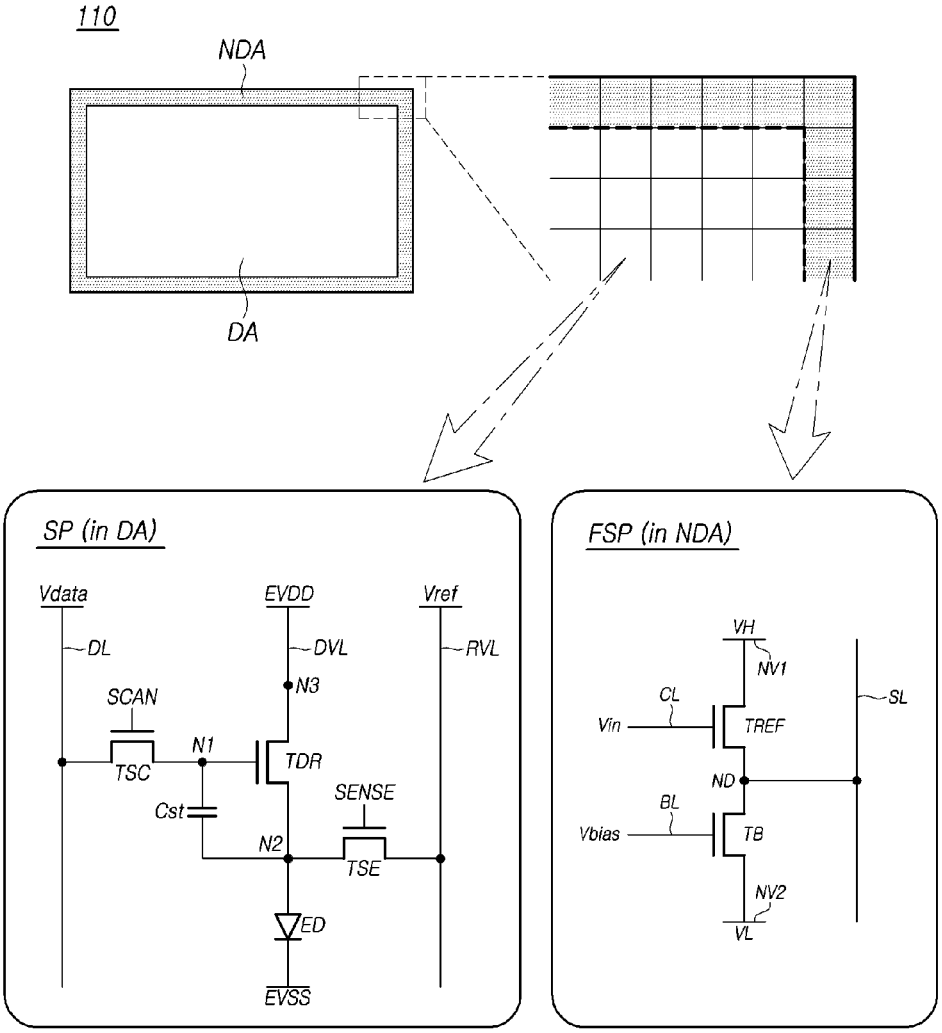
FIG. 7 is a view illustrating subpixels disposed in a display area and fake subpixels disposed in a non-display area in a self-emission display device according to an embodiment of the disclosure.
Figure 8:
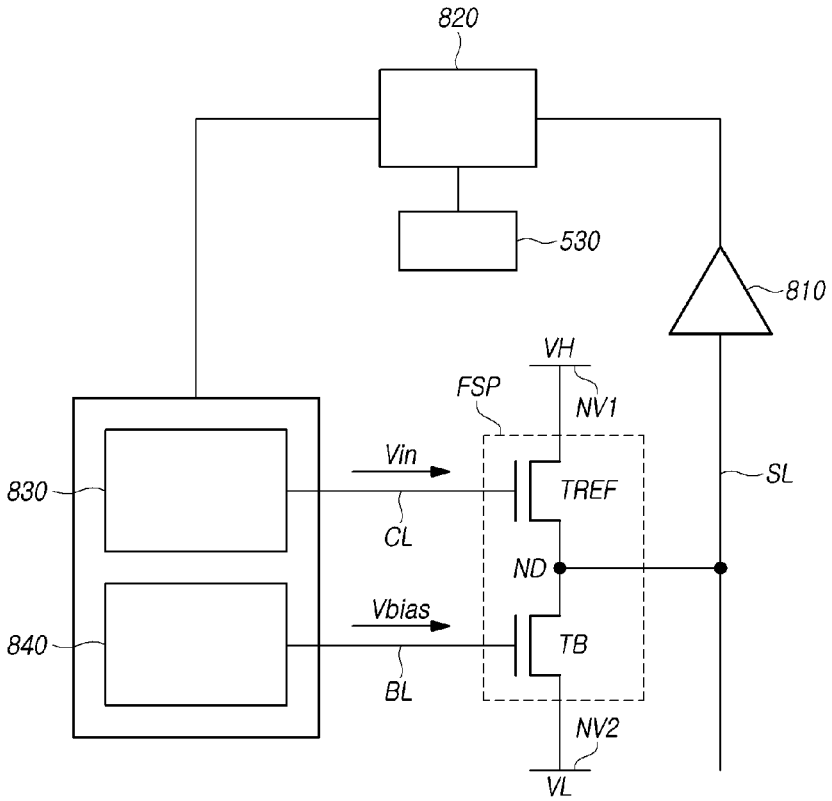
FIG. 8 is a view illustrating an initial characteristic value restoration circuit of a self-emission display device according to an embodiment of the disclosure.

FIG. 7 is a view illustrating subpixels SP disposed in a display area DA and fake subpixels FSP (e.g., dummy subpixels) disposed in a non-display area NDA in a self-emission display device 100 according to an embodiment of the disclosure. FIG. 8 is a view illustrating an initial characteristic value restoration circuit of a self-emission display device 100 according to an embodiment of the disclosure.

Referring to FIG. 7, according to an embodiment, a self-emission display device 100 may include a self-emission display panel 110 including a display area DA and a non-display area NDA, a plurality of subpixels SP disposed in the display area DA and each including a light emitting element ED and a driving transistor TDR, a plurality of data lines DL and a plurality of gate lines GL connected with the plurality of subpixels SP, a data driving circuit 120 driving the plurality of data lines DL, and a gate driving circuit 130 driving the plurality of gate lines GL.

Referring to FIGS. 7 and 8, an initial characteristic value restoration circuit may include a fake subpixel FSP, a detection unit 810, and a control module 820.

Referring to FIGS. 7 and 8, the fake subpixel FSP may include a reference transistor TREF and a bias transistor TB.

The reference transistor TREF may be disposed in the non-display area NDA of the self-emission display panel 110, be controlled by a control signal Vin, and be connected between a first voltage node NV1 and a detection node ND.

The bias transistor TB may be controlled by a bias voltage Vbias and may be connected between a second voltage node NV2 and the detection node ND.

Referring to FIG. 7, a high potential power source voltage VH may be applied to the first voltage node NV1, and a low potential power source voltage VL may be applied to the second voltage node NV2. The high potential power voltage VH may be the same voltage as the driving voltage EVDD supplied to the subpixel SP in the display area DA, and the low potential power voltage VL may be the same voltage as the base voltage EVSS supplied to the subpixel SP in the display area DA.

Referring to FIG. 8, the detection unit 810 may be connected with the detection node ND of the fake subpixel FSP through a sensing line SL. The detection unit 810 may detect the voltage of the detection node ND in the fake subpixel FSP through the sensing line SL and output a detection value. For example, the detection unit 810 may be implemented as an analog-to-digital converter. In this case, the detection unit 810 may detect the voltage of the detection node ND in the fake subpixel FSP through the sensing line SL, convert the detected voltage into a detection value, which is a digital value, and output the detection value.

Referring to FIG. 8, the control module 820 may control driving of the fake subpixel FSP based on the detection value.

Specifically, the control module 820 may determine, based on the detection value, whether to continue driving the fake subpixel FSP while increasing the voltage of the control signal Vin or to stop increasing the voltage of the control signal Vin (i.e., stop driving the fake subpixel FSP), and perform the process of calculating the initial characteristic value (e.g., the initial threshold voltage) using the voltage of the detection node ND detected via the sensing line SL.

If the voltage of the detection node ND recognized based on the detection value is less than a predetermined specific voltage, the control module 820 may keep on driving the fake subpixel FSP while increasing the voltage of the control signal Vin. If the voltage of the detection node ND recognized based on the detection value is equal to or higher than the predetermined specific voltage, the control module 820 may stop increasing the voltage of the control signal Vin and perform the process of calculating the initial characteristic value (e.g., initial threshold voltage).

Before the self-light emitting display device 100 is shipped, the memory 530 may store the initial characteristic values of the driving transistors TDR included in the plurality of subpixels SP. The characteristic value of the driving transistor TDR may include the threshold voltage or mobility of the driving transistor TDR.

If the initial characteristic value stored in the memory 530 is deleted or damaged, the control module 820 may detect this and store the initial characteristic value in the memory 530 by driving the fake subpixel FSP, restoring the initial characteristic value.

If information for the address where the initial characteristic value is stored (recorded) in the memory 530 is not stored, the control module 820 may determine that the initial characteristic value stored in the memory 530 has been deleted out. If the initial characteristic value stored in the memory 530 falls out of a normal range, the control module 820 may determine that the initial characteristic value stored in the memory 530 has been damaged.

Referring to FIG. 8, the control module 820 may control driving of the fake subpixel FSP based on the detection value output from the detection unit 810, infer the initial characteristic values of the driving transistors TDR included in all or some of the plurality of subpixels SP based on the detection value, change the initial characteristic value already stored in the memory 530 into the inferred initial characteristic value or store the inferred initial characteristic value in the memory 530.

Referring to FIG. 7, the self-emission display panel 110 may include a control signal line CL electrically connected with the gate node of the reference transistor TREF and a bias signal line BL electrically connected with the gate node of the bias transistor TB.

Referring to FIGS. 7 and 8, the reference transistor TREF in the fake subpixel FSP of the non-display area NDA may be a transistor that simulates the driving transistor TDR in the subpixel SP of the display area DA.

Referring to FIGS. 7 and 8, if the characteristic value (e.g., threshold voltage or mobility) of the reference transistor TREF in the fake subpixel FSP of the non-display area NDA is sensed, the initial characteristic value (e.g., initial threshold voltage or mobility) of the driving transistor TDR in the subpixel SP of the display area DA may be inferred.

Referring to FIGS. 7 and 8, the channel width-to-channel length ratio of the reference transistor TREF included in the fake subpixel FSP may be identical to, or different, within a preset range, from, the channel width-to-channel length ratio of the driving transistor TDR included in each of the plurality of subpixels SP.

Accordingly, the reference transistor TREF having the same electrical characteristics as those of the driving transistor TDR included in the actual subpixel SP disposed in the display area DA may be disposed in the fake subpixel FSP of the non-display area NDA.

The fake subpixel FSP disposed in the non-display area NDA may be a non-emission subpixel. Accordingly, degradation of the reference transistor TREF in the fake subpixel FSP may be prevented or at least reduced.

Since the fake subpixel FSP of the non-display area NDA does not emit light, variation in the characteristic value of the reference transistor TREF included in the fake subpixel FSP disposed in the non-display area NDA may be smaller than variation in the characteristic value of the driving transistor TDR included in each of the plurality of subpixels SP disposed in the area DA.

Since the fake subpixel FSP of the non-display area NDA does not emit light, if a plurality of fake subpixels FSP are disposed in the non-display area NDA, deviations in characteristic value between the reference transistors TREF included in the plurality of fake subpixels FSP may be smaller than deviations in characteristic value between the driving transistors DRT included in the plurality of subpixels SP disposed in the display area DA.

As described above, since the fake subpixel FSP of the non-display area NDA does not emit light, the reference transistor TREF in the fake subpixel FSP of the non-display area NDA is not degraded even after the self-emission display device 100 is driven for a long period of time. Accordingly, even after the self-emission display device 100 is driven for a long period of time, the characteristic value of the reference transistor TREF in the fake subpixel FSP of the non-display area NDA may have the same or a similar value to the initial characteristic value (the normal initial characteristic value obtained upon initial compensation) of the driving transistor TDR in the subpixel SP of the display area DA.

As described above, the memory 530 may store initial characteristic values (e.g., threshold voltages or mobility) of the driving transistors TDR included in the plurality of subpixels SP.

Before the self-light emitting display device 100 is shipped, the memory 530 may store the initial characteristic values of the driving transistors TDR included in the plurality of subpixels SP.

The characteristic value of the driving transistor TDR may be the initial threshold voltage of the driving transistor TDR.

Referring to FIGS. 7 and 8, the bias voltage Vbias applied to the gate node of the bias transistor TB is larger than or equal to the lowest voltage capable of turning on the bias transistor TB and less than the voltage of the control signal Vin.

According to an embodiment, the self-emission display device 100 may further include one or more integrated circuits SDIC in which the data driving circuit 120 is implemented and a controller 140 for controlling the data driving circuit 120 and the gate driving circuit 130.

The detection unit 810 of the initial characteristic value restoration circuit, together with the whole or part of the data driving circuit 120, may be included in a single integrated circuit (SDIC). The control module 820 of the initial characteristic value restoration circuit may be included in the controller 140 that controls display driving.

A plurality of fake subpixels FSP may be disposed in the non-display area NDA. Each of the plurality of fake subpixels FSP may be disposed corresponding to one of a plurality of subpixel SP rows disposed in the display area DA, or corresponding to one of a plurality of subpixel SP columns disposed in the display area DA.

The above-described initial characteristic value compensation circuit and its operations are described below in more detail.

Figure 9:
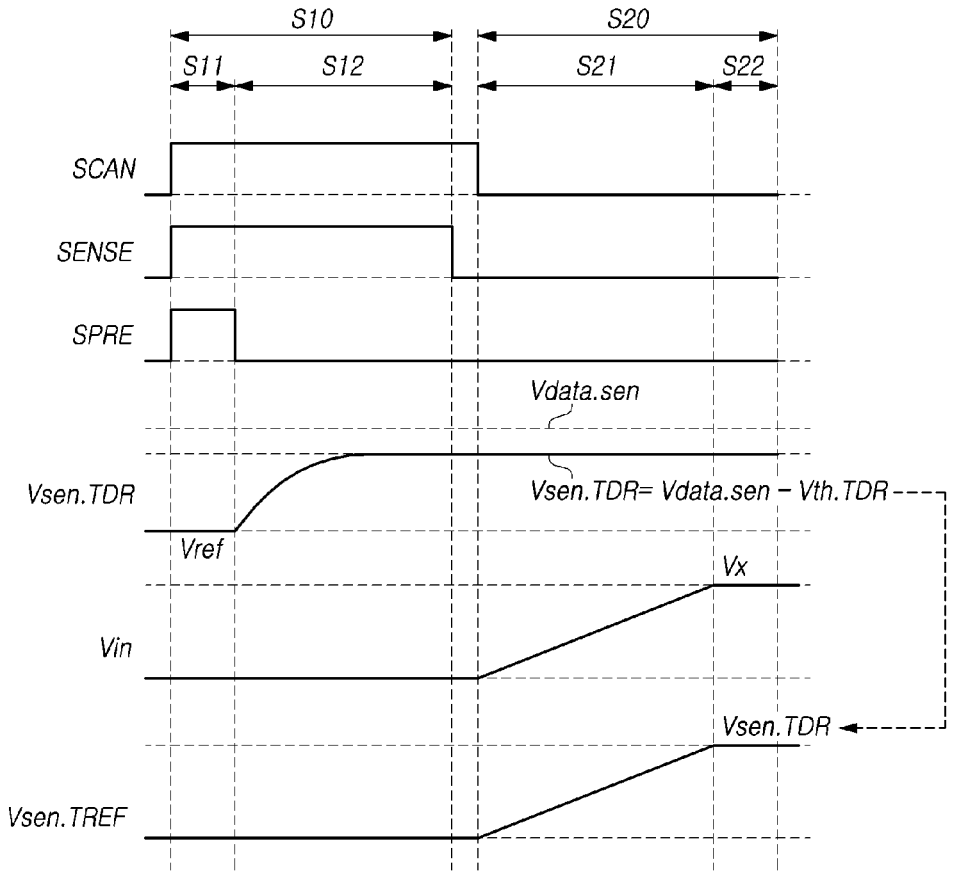
FIG. 9 is a driving timing diagram illustrating an example of restoring an initial characteristic value of a self-emission display device according to an embodiment of the disclosure.
Figure 10:
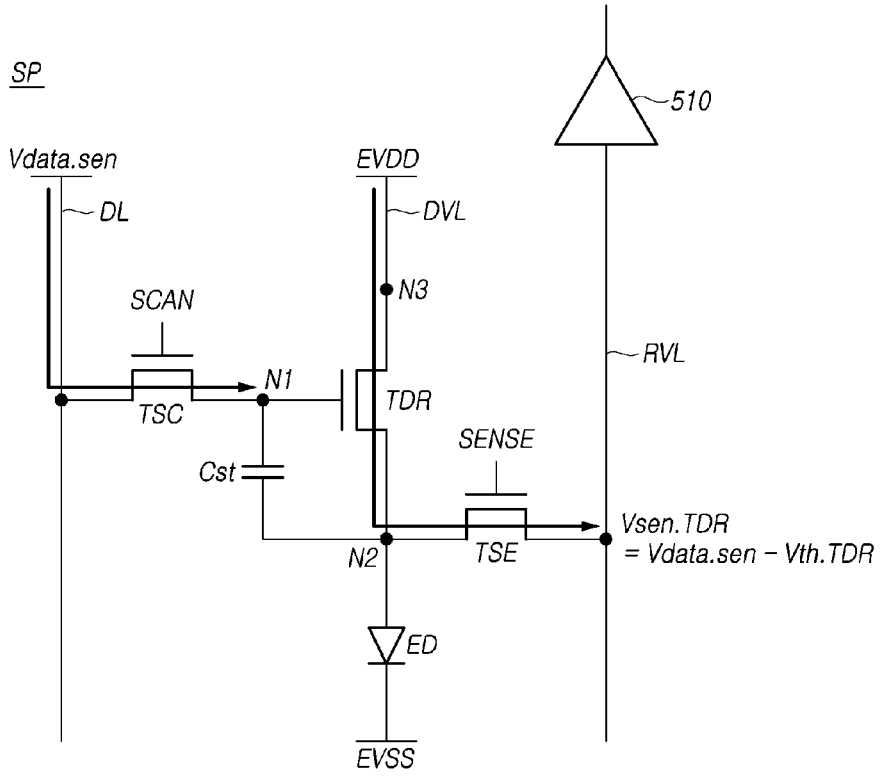
FIG. 10 is a view illustrating an example of sensing driving in a subpixel in a display area for restoring an initial characteristic value of a self-emission display device according to an embodiment of the disclosure.
Figure 11:
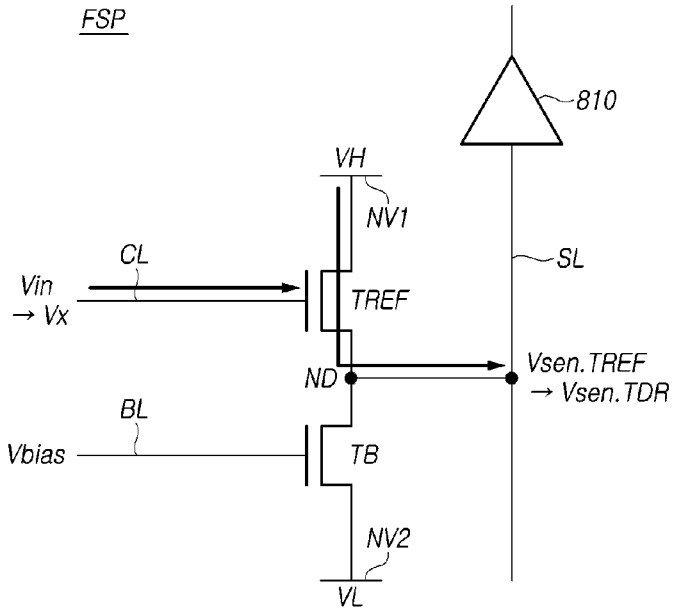
FIG. 11 is a view illustrating an example of sensing driving of a fake subpixel in a non-display area for restoring an initial characteristic value of a self-emission display device according to an embodiment of the disclosure.

FIG. 9 is a driving timing diagram illustrating an example of restoring an initial characteristic value of a self-emission display device 100 according to an embodiment of the disclosure. FIG. 10 is a view illustrating an example of sensing driving in a subpixel SP in a display area DA for restoring an initial characteristic value of a self-emission display device 100 according to an embodiment of the disclosure. FIG. 11 is a view illustrating an example of sensing driving of a fake subpixel FSP in a non-display area NDA for restoring an initial characteristic value of a self-emission display device 100 according to an embodiment of the disclosure.

Referring to FIG. 9, according to an embodiment, the self-emission display device 100 may perform sensing driving on the fake subpixels FSP to restore initial characteristic values.

Referring to FIGS. 9 and 11, during a sensing driving period S20 for the fake subpixel FSP, in a state in which a high potential power voltage VH is applied to the first voltage node NV1 and a low potential power voltage VL is applied to the second voltage node NV2, the control signal supply unit 830 may supply the control signal Vin to the gate node of the reference transistor TREF through the control signal line CL, and the bias voltage supply unit 840 may supply the bias voltage Vbias to the gate node of the bias transistor TB through the bias signal line BL.

Referring to FIGS. 9 and 11, during the sensing driving period S20 for the fake subpixel FSP, the control module 820 may control the operation of the control signal supply unit 830 and the bias voltage supply unit 840.

Referring to FIGS. 9 and 11, the sensing driving period S20 for the fake subpixel FSP may include a tracking period S21 during which the voltage of the control signal Vin rises and a detection period S22 during which the rise of the voltage of the control signal Vin is stopped, and the voltage of the detection node ND is detected.

Referring to FIGS. 9 and 11, during the tracking period S21 of the sensing driving period S20 for the fake subpixel FSP, under the control of the control module 820, the bias voltage supply unit 840 may output a bias voltage Vbias which is a direct current (DC) voltage whose voltage level does not change, and the control signal supply unit 830 may increase (elevate) and output the voltage of the control signal Vin.

Referring to FIGS. 9 and 11, during the tracking period S21 of the sensing driving period S20 for the fake subpixel FSP, that is, while the voltage of the control signal Vin increases (rises), the voltage Vsen.TREF of the detection node ND may rise.

In other words, referring to FIGS. 9 and 11, during the sensing driving period S20 for the fake subpixel FSP, in a state in which the high potential power voltage VH is applied to the first voltage node NV1, the low potential power voltage VL is applied to the second voltage node NV2, and the bias voltage Vbias is applied to the gate node of the bias transistor TB, the voltage of the control signal Vin may rise, and the voltage Vsen.TREF of the detection node may rise.

Referring to FIGS. 9 and 11, during the sensing driving period S20 for the fake subpixel FSP, the reference transistor TREF and the bias transistor TB may be turned on by the control signal Vin and the bias voltage Vbias, respectively.

Referring to FIGS. 9 and 11, during the tracking period S21, under the control of the control module 820, the control signal supply unit 830 increases and outputs the voltage of the control signal Vin. In other words, during the tracking period S21, the control module 820 may control to increase the voltage of the control signal Vin until the voltage Vsen.TREF of the detection node ND detected by the detection unit 810 rises to a specific voltage.

According to the result of detection of the voltage of the detection node ND detected by the detection unit 810, if the elevated voltage Vsen.TREF of the detection node ND becomes the specific voltage, the tracking period S21 ends and the detection period S22 begins.

In other words, if the elevated voltage Vsen.TREF of the detection node ND becomes the specific voltage according to the result of detection of the voltage of the detection node ND detected by the detection unit 810, the control module 820 may control the operation of the control signal supply unit 840 so that the voltage of the control signal Vin is not elevated, thereby terminating the tracking period S21.

If the elevated voltage of the detection node ND becomes the specific voltage, the control module 820 may infer the initial characteristic values of the driving transistors DRT included in all or some of the plurality of subpixels SP based on the elevated voltage Vx of the control signal Vin at the timing when the elevated voltage Vsen.TREF of the detection node ND becomes the specific voltage and store the inferred initial characteristic values in the memory 530.

Referring to FIG. 9, to restore the initial characteristic value, the sensing driving period S10 may be performed on the subpixel SP of the display area DA before the sensing driving period S20 for the fake subpixel FSP of the non-display area NDA, Referring to FIGS. 9 and 10, the sensing driving period S10 for a first subpixel SP among the plurality of subpixels SP is a driving period for sensing the threshold voltage Vth.TDR of the driving transistor TDR in the first subpixel SP1 and may include an initialization period S11 and a sensing period S12.

As described above, to provide a compensation function by sensing the threshold voltage Vth.TDR of the driving transistor TDR, the self-emission display device 100 may further include a sensing unit 510, which senses the voltage of the reference voltage line RVL connected with the first subpixel SP, converts the sensed voltage Vsen.TDR into a sensing value corresponding to a digital value, and outputs the sensing value, and a compensation unit 520, which calculates a compensation value for compensating for the deviation in luminance between the first subpixel SP and another subpixel SP based on the sensing value output from the sensing unit 510.

The compensation unit 520 may grasp the threshold voltage Vth.TDR of the driving transistor TDR of the first subpixel SP based on the sensing value output from the sensing unit 510, grasp the threshold voltage Vth.TDR of the driving transistor TDR of a subpixel SP different from the first subpixel SP, and grasp the deviation in threshold voltage between the driving transistors TDR.

Referring to FIG. 9, before the sensing driving period S20 for the fake subpixel FSP, the sensing driving period S10 for the first subpixel SP may be performed and, during the sensing driving period S10 for the first subpixel SP, the voltage Vsen.TDR of the reference voltage line RVL connected with the first subpixel SP is elevated and saturated. If the voltage Vsen.TDR of the reference voltage line RVL is elevated and saturated, the sensing unit 510 may sense the voltage Vsen.TDR of the reference voltage line RVL connected by the sampling switch SAM, convert the sensed voltage Vsen.TDR into a sensing value, which is a digital value, and output the sensing value.

Referring to FIG. 9, during the initialization period S11 of the sensing driving period S10 for the first subpixel SP, the first node N1 of the driving transistor TDR is initialized as the sensing driving data voltage Vdata.sen, and the second node N2 of the driving transistor TDR is initialized as the reference voltage Vref.

Referring to FIGS. 9 and 10, during the sensing period S12 of the sensing driving period S10 for the first subpixel SP, the first node N1 of the driving transistor TDR may be maintained as the sensing driving data voltage Vdata.sen, and the second node N2 of the driving transistor TDR is electrically floated. Accordingly, source following occurs, so that the voltage of the second node N2 of the driving transistor TDR rises.

Referring to FIGS. 9 and 10, during the sensing period S12 of the sensing driving period S10 for the first subpixel SP, if the voltage of the second node N2 of the driving transistor TDR is elevated, the gate-source voltage difference Vgs of the driving transistor TDR reduces.

Thus, during the sensing period S12 of the sensing driving period S10 for the first subpixel SP, if the voltage of the second node N2 of the driving transistor TDR rises and the gate-source voltage difference Vgs of the driving transistor TDR becomes the threshold voltage Vth.TDR, the driving transistor TDR is turned off, and the voltage of the second node N2 of the driving transistor TDR stops rising (saturated).

In this case, the voltage of the first node N1 of the driving transistor TDR is the sensing driving data voltage Vdata.sen, and the voltage of the second node N2 of the driving transistor TDR may be the sensing driving data voltage Vdata.sen less the threshold voltage Vth.TDR of the driving transistor TDR (i.e., Vdata.sen-Vth.TDR).

Referring to FIGS. 9 and 10, in the saturated state in which the voltage of the second node N2 of the driving transistor TDR stops rising, the sensing unit 510 may be connected with the reference voltage line RVL by the sampling switch SAM, sensing the voltage Vsen.TDR of the reference voltage line RVL. In this case, the sensed voltage Vsen.TDR is the saturated voltage of the second node N2 of the driving transistor TDR and may be the sensing driving data voltage Vdata.sen less the threshold voltage Vth.TDR of the driving transistor TDR (i.e., Vdata.sen-Vth.TDR).

Referring to FIG. 9, the voltage Vsen.TDR sensed by the sensing unit 510 during the sensing driving period S10 for the first subpixel SP may be a specific voltage necessary for the control module 820 to determine the timing for stopping the rise in the voltage of the control signal Vin.

Further, the voltage Vsen.TDR sensed by the sensing unit 510 during the sensing driving period S10 for the first subpixel SP may be the same voltage value as the voltage Vsen.TREF of the detection node ND in the fake subpixel FSP when the rise in the voltage of the control signal Vin stops.

During the sensing driving period S20 of the fake subpixel FSP of the non-display area NDA, the control module 820 may sense the threshold voltage Vth.TREF of the reference transistor TREF in the fake subpixel FSP of the non-display area NDA.

The threshold voltage Vth.TREF of the reference transistor TREF in the fake subpixel FSP of the non-display area NDA may correspond to the initial threshold voltage Vth.init of the driving transistor TDR in the subpixel SP of the display area DA (refer to Equation 1).

The control module 820 may infer the initial threshold voltage Vth.init, as the initial characteristic value of the driving transistor TDR of the first subpixel SP, based on the specific voltage Vsen.TDR or the elevated voltage Vsen.TREF of the detection node ND and the elevated voltage Vx of the control signal Vin at the timing when the elevated voltage Vsen.TREF of the detection node ND becomes the specific voltage Vsen.TDR and store the inferred initial threshold voltage in the memory 530.

Referring to Equation 1 below, the initial threshold voltage Vth.init of the driving transistor TDR may be obtained by subtracting the elevated voltage Vsen.TREF of the detection node ND or the specific voltage Vsen.TDR from the elevated voltage Vx of the control signal Vin at the timing when the elevated voltage Vsen.TREF of the detection node ND becomes the specific voltage Vsen.TDR (i.e., Vx−Vsen.TREF=Vx−Vsen.TDR).

Further, the control module 820 may infer the initial threshold voltage Vth.init, as the initial characteristic value of the driving transistor TDR of the first subpixel SP, based on the threshold voltage Vth.TDR of the driving transistor TDR of the first subpixel SP sensed during the sensing driving period S10 for the first subpixel SP and the sensing driving data voltage Vdata.sen supplied to the first subpixel SP during the sensing driving period S10 for the first subpixel SP and the elevated voltage Vx of the control signal Vin at the timing when the elevated voltage Vsen.TREF of the detection node ND becomes the specific voltage Vsen.TDR and store the initial threshold voltage in the memory 530.

Referring to Equation 1 below, the initial threshold voltage Vth.init of the driving transistor TDR may be obtained by subtracting the sensing driving data voltage Vdata.sen from the sensed threshold voltage Vth.TDR of the driving transistor TDR and adding the voltage Vx where the rise in the voltage of the control signal Vin stops (i.e., Vth.TDR−(Vdata.sen−Vx)=Vth.TDR−Vdata.sen+Vx)).

$$Vth.init = Vth.TREF = Vx - Vsen.TREF = Vx - Vsen.TDR = Vth.TDR - (Vdata.sen - Vx) \quad \text{[Equation 1]}$$

Figure 12:
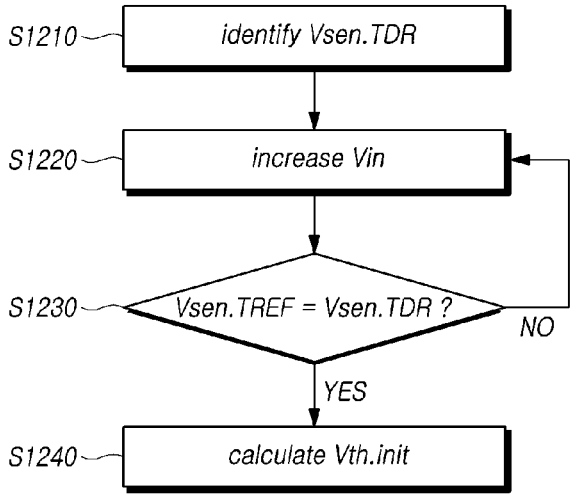
FIG. 12 is a flowchart illustrating a method for restoring an initial characteristic value of a self-emission display device according to an embodiment of the disclosure.

FIG. 12 is a flowchart illustrating a method for restoring an initial characteristic value of a self-emission display device 100 according to an embodiment of the disclosure.

Referring to FIG. 12, according to an embodiment, a method for restoring an initial characteristic value of a self-emission display device 100 may include: identifying the voltage Vsen.TDR of the reference voltage line RVL sensed by the sensing unit 510 during the sensing driving period S10 of the driving transistor TDR in the subpixel SP of the display area DA (S1210), increasing the voltage level of the control signal Vin step-by-step (S1220), and determining whether the voltage Vsen.TREF of the detection node ND in the fake subpixel FSP in the increased voltage of the control signal Vin is identical to the voltage Vsen.TDR identified in step S1210 (S1230)

If it is determined in step S1230 that the voltage Vsen.TREF of the detection node ND in the fake subpixel FSP is not identical to the voltage Vsen.TDR identified in step S1210, the process may return to step S1220, increasing the voltage level of the control signal Vin step-by-step.

Steps S1220 and S1230 are repeatedly performed until the voltage Vsen.TREF of the detection node ND in the fake subpixel FSP is determined to be identical to the voltage Vsen.TDR identified in step S1210.

If it is determined in step S1230 that the voltage Vsen.TREF of the detection node ND in the fake subpixel FSP is identical to the voltage Vsen.TDR identified in step S1210, the initial threshold voltage Vth.init of the driving transistor TDR in the subpixel SP of the display area DA is calculated (S1240). The control module 820 may calculate the initial threshold voltage Vth.init of the driving transistor TDR using Equation 1 above.

According to the above-described embodiments of the disclosure, there may be provided a self-emission display device 100 and self-emission display panel 110 that may precisely grasp variations in the characteristic values of the circuit elements in the subpixels SP after shipped and correctly compensate for luminance deviations between the subpixels SP by sensing and storing, in the memory 530, the initial characteristic values (e.g., initial threshold voltages and/or initial mobility of the driving transistors DRT and initial threshold voltages of the light emitting elements) of circuit elements (e.g., driving transistors DRT and light emitting elements ED) in the subpixels SP disposed in the self-emission display panel 110 before the self-emission display panel 110 is shipped.

According to the embodiments of the disclosure, there may be provided a self-emission display device 100 and self-emission display panel 110 that may restore the initial characteristic values of circuit elements in the subpixels SP disposed on the self-emission display panel 110 when the initial characteristic values of the circuit elements in the subpixels are lost or damaged and may thus continuously perform precise compensation processing.

According to the embodiments of the disclosure, there may be provided a self-emission display device 100 and self-emission display panel 110 that includes an initial characteristic value restoration circuit capable of restoring the initial characteristic values of circuit elements in the subpixels SP disposed on the self-emission display panel 110 when the initial characteristic values of the circuit elements are lost from the memory or damaged.

The above description has been presented to enable any person skilled in the art to make and use the technical idea of the disclosure, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the disclosure. The above description and the accompanying drawings provide an example of the technical idea of the disclosure for illustrative purposes only. That is, the disclosed embodiments are intended to illustrate the scope of the technical idea of the disclosure. Thus, the scope of the disclosure is not limited to the embodiments shown, but is to be accorded the widest scope consistent with the claims. The scope of protection of the disclosure should be construed based on the following claims, and all technical ideas within the scope of equivalents thereof should be construed as being included within the scope of the disclosure.

What is claimed is:

1. A self-emission display device, comprising:

a self-emission display panel including a display area and a non-display area around the display area, the self-emission display panel including a plurality of subpixels disposed in the display area and a plurality of data lines and a plurality of gate lines connected with the plurality of subpixels, each of the plurality of subpixels including a light emitting element and a driving transistor;

a data driving circuit configured to drive the plurality of data lines;

a gate driving circuit configured to drive the plurality of gate lines;

a fake subpixel disposed in the non-display area of the self-emission display panel, the fake subpixel including a reference transistor and a bias transistor, wherein the reference transistor is controlled by a control signal applied to a gate node thereof from a control signal supplier through a control signal line and is connected between a first voltage node and a detection node, and the bias transistor is controlled by a bias voltage and connected between a second voltage node and the detection node;

a detection unit connected with the fake subpixel, the detection unit configured to detect a voltage of the detection node in the fake subpixel, and outputting a detection value; and a control module configured to control driving of the fake subpixel based on the detection value.

2. The self-emission display device of claim 1, wherein the fake subpixel disposed in the non-display area is a non-self-emission subpixel.

3. The self-emission display device of claim 1, wherein a variation in a characteristic value of the reference transistor included in the fake subpixel disposed in the non-display area is less than a variation in a characteristic value of the driving transistor included in each of the plurality of subpixels disposed in the display area.

4. The self-emission display device of claim 1, further comprising a memory storing an initial characteristic value of the driving transistor included in each of the plurality of subpixels, wherein the memory stores the initial characteristic value of the driving transistor included in each of the plurality of subpixels before the self-emission display device is shipped out, and wherein the control module is configured to control driving of the fake subpixel based on the detection value, configured to infer initial characteristic values of driving transistors included in all or some of the plurality of subpixels based on the detection value, changes the initial characteristic value stored in the memory into an inferred initial characteristic value, or configured to store the inferred initial characteristic values in the memory.

5. The self-emission display device of claim 4, wherein the initial characteristic value of the driving transistor corresponds to a characteristic value of the reference transistor when the self-emission display device is shipped out.

6. The self-emission display device of claim 4, wherein during a sensing driving period for the fake subpixel, in a state in which a high potential power source voltage is applied to the first voltage node, a low potential power source voltage is applied to the second voltage node, and the bias voltage is applied to a gate node of the bias transistor, a voltage of the control signal and a voltage of the detection node are elevated.

7. The self-emission display device of claim 6, wherein the reference transistor and the bias transistor are turned on during the sensing driving period for the fake subpixel.

8. The self-emission display device of claim 6, wherein the control module is configured to elevate the voltage of the control signal until the voltage of the detection node is elevated to a specific voltage, and wherein responsive to the elevated voltage of the detection node being equal to the specific voltage, the control module is configured to infer initial characteristic values of driving transistors included in all or some of the plurality of subpixels based on the elevated voltage of the control signal at a timing when the elevated voltage of the detection node is equal to the specific voltage, and stores the inferred initial characteristic values in the memory.

9. The self-emission display device of claim 8, wherein each of the plurality of subpixels further includes a scan transistor controlled by a scan signal and connected between a first node of the driving transistor and the data line, a sense transistor controlled by a sense signal and connected between a second node of the driving transistor and a reference voltage line, and a storage capacitor connected between the first node and second node of the driving transistor, wherein the self-emission display device further comprises:

a sensing unit configured to sense a voltage of the reference voltage line connected with a first subpixel among the plurality of subpixels during a sensing driving period for the first subpixel, converting the sensed voltage into a digital sensing value, and outputting the digital sensing value; and a compensation unit configured to calculate a compensation value for compensating for a luminance deviation between the first subpixel and another subpixel based on the sensing value, wherein before a sensing driving period for the fake subpixel, a sensing driving period for the first subpixel proceeds, responsive to the voltage of the reference voltage line connected with the first subpixel being elevated and saturated during the sensing driving period for the first subpixel, the sensing unit is configured to sense the voltage of the reference voltage line, configured to convert the sensed voltage into a digital sensing value, and configured to output the digital sensing value, and wherein the voltage sensed by the sensing unit during the sensing driving period for the first subpixel is the specific voltage.

10. The self-emission display device of claim 9, wherein the control module infers an initial threshold voltage as the initial characteristic value of the driving transistor of the first subpixel based on the specific voltage or the elevated voltage of the detection node and the elevated voltage of the control signal at the timing when the elevated voltage of the detection node is equal to the specific voltage and stores the initial threshold voltage in the memory.

11. The self-emission display device of claim 9, wherein, based on the elevated voltage of the control signal at the timing when the elevated voltage of the detection node is equal to the specific voltage, a sensing driving data voltage supplied to the first subpixel during the sensing driving period for the first subpixel, and a threshold voltage of the driving transistor of the first subpixel sensed during the sensing driving period for the first subpixel, the control module infers an initial threshold voltage as the initial characteristic value of the driving transistor of the first subpixel and stores the initial threshold voltage in the memory.

12. The self-emission display device of claim 1, wherein the bias voltage is greater than or equal to a minimum voltage at which the bias transistor may be turned on and is less than the voltage of the control signal.

13. The self-emission display device of claim 1, further comprising one or more integrated circuits (ICs) in which the data driving circuit is implemented and a controller controlling the data driving circuit and the gate driving circuit, wherein the detection unit, along with a whole or part of the data driving circuit, is included in one IC, and wherein the control module is included in the controller.

14. The self-emission display device of claim 1, wherein a plurality of fake subpixels are disposed in the non-display area, and wherein each of the plurality of fake subpixels is disposed in the non-display area, each of the plurality of fake subpixels corresponds to one of a plurality of subpixel rows disposed in the display area or corresponds to one of a plurality of subpixel columns disposed in the display area.

15. The self-emission display device of claim 1, wherein a channel width-to-channel length ratio of the reference transistor included in the fake subpixel is equal to a channel width-to-channel length ratio of the driving transistor included in each of the plurality of subpixels or is different, within a preset range, from the channel width-to-channel length ratio of the driving transistor included in each of the plurality of subpixels.

16. A self-emission display device comprising:

a self-emission display panel including a display area and a non-display area around the display area, the self-emission display panel including a plurality of subpixels disposed in the display area and a plurality of data lines and a plurality of gate lines connected with the plurality of subpixels, each of the plurality of subpixels including a light emitting element and a driving transistor;

a data driving circuit configured to drive the plurality of data lines;

a gate driving circuit configured to drive the plurality of gate lines;

a fake subpixel disposed in the non-display area of the self-emission display panel, the fake subpixel including a reference transistor and a bias transistor, wherein the reference transistor is controlled by a control signal and is connected between a first voltage node and a detection node, and the bias transistor is controlled by a bias voltage and connected between a second voltage node and the detection node;

a detection unit connected with the fake subpixel, the detection unit configured to detect a voltage of the detection node in the fake subpixel, and outputting a detection value; and a control module configured to control driving of the fake subpixel based on the detection value, wherein a deviation in a characteristic value between reference transistors included in a plurality of fake subpixels in the non-display area is less than a deviation in characteristic value between driving transistors included in the plurality of subpixels disposed in the display area.

17. A self-emission display panel, comprising:

a substrate including a display area and a non-display area around the display area;

a subpixel disposed in the display area, the subpixel including a light emitting element and a driving transistor; and a fake subpixel disposed in the non-display area, the fake subpixel including a reference transistor and a bias transistor, the reference transistor controlled by a control signal and connected between a first voltage node and a detection node, and the bias transistor controlled by a bias voltage and connected between a second voltage node and the detection node, wherein a deviation in a characteristic value between reference transistors included in a plurality of fake subpixels in the non-display area is less than a deviation in characteristic value between driving transistors included in a plurality of subpixels disposed in the display area.

18. The self-emission display panel of claim 17, wherein the fake subpixel disposed in the non-display area is a non-self-emission subpixel.

19. The self-emission display panel of claim 17, wherein a variation in a characteristic value of the reference transistor included in the fake subpixel disposed in the non-display area is less than a variation in a characteristic value of the driving transistor included in each of a plurality of subpixels disposed in the display area.

20. The self-emission display panel of claim 17, further comprising a control signal line electrically connected with a gate node of the reference transistor and a bias signal line electrically connected with a gate node of the bias transistor.

* * * * *